US011253021B2

(12) United States Patent
Saijo

(10) Patent No.: US 11,253,021 B2
(45) Date of Patent: Feb. 22, 2022

(54) HELMET

(71) Applicant: SHOEI CO., LTD., Tokyo (JP)

(72) Inventor: Yoshiaki Saijo, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 76 days.

(21) Appl. No.: 16/615,651

(22) PCT Filed: Mar. 5, 2018

(86) PCT No.: PCT/JP2018/008423
§ 371 (c)(1),
(2) Date: Nov. 21, 2019

(87) PCT Pub. No.: WO2018/216306
PCT Pub. Date: Nov. 29, 2018

(65) Prior Publication Data

US 2020/0085131 A1 Mar. 19, 2020

(30) Foreign Application Priority Data

May 22, 2017 (JP) ..... JP2017-100732

(51) Int. Cl.
*A42B 3/12* (2006.01)
*A42B 3/06* (2006.01)
*A42B 3/28* (2006.01)

(52) U.S. Cl.
CPC ..... *A42B 3/12* (2013.01); *A42B 3/06* (2013.01); *A42B 3/064* (2013.01); *A42B 3/127* (2013.01); *A42B 3/28* (2013.01); *A42B 3/281* (2013.01)

(58) Field of Classification Search
CPC ..... A42B 3/06; A42B 3/064; A42B 3/127; A42B 3/12; A42B 3/10; A42B 3/281; A42B 3/28

(Continued)

(56) References Cited

U.S. PATENT DOCUMENTS 5,345,614 A 9/1994 Haruo
5,867,840 A 2/1999 Hirosawa
(Continued)

FOREIGN PATENT DOCUMENTS

JP 9-188913 A 7/1997
JP 2001-295129 A 10/2001
(Continued)

OTHER PUBLICATIONS

International Search Report dated Apr. 6, 2018 for Related Appln. No. PCT/JP2018/008423; 4 Pages.
(Continued)

*Primary Examiner* — Jameson D Collier
*Assistant Examiner* — Matthew R Marchewka
(74) *Attorney, Agent, or Firm* — Brooks Kushman P.C.

(57) ABSTRACT

A helmet that can effectively reduce the rotational acceleration of an impact and at the same time also effectively reduce translational acceleration is provided. A helmet has an outer shell including a hard material and a shock absorbing liner (14) disposed inside the shell. The shock absorbing liner (14) includes a main body liner (16), a recessed portion (30) provided at an inner surface of the main body liner (16), an insert liner (18) fitted into the recessed portion (30), and a central raised portion (42) (central support member) disposed between a bottom surface of the recessed portion (30) and a bottom surface of the insert liner (18). When the helmet receives an impact, the insert liner (18) swings about the central support member as a fulcrum, thereby reducing the impact.

18 Claims, 11 Drawing Sheets

(58) Field of Classification Search
USPC ..... 2/410, 411, 412, 414
See application file for complete search history.

(56) References Cited

U.S. PATENT DOCUMENTS

| | | | | |
|---|---|---|---|---|
| 2001/0032351 | A1 | 10/2001 | Nakayama | |
| 2002/0174480 | A1* | 11/2002 | Lombard | A42B 3/20 2/424 |
| 2007/0000032 | A1* | 1/2007 | Morgan | A42B 3/124 2/412 |
| 2012/0060251 | A1* | 3/2012 | Schimpf | A42B 3/064 2/5 |
| 2012/0198604 | A1* | 8/2012 | Weber | A42B 3/125 2/414 |
| 2014/0259316 | A1* | 9/2014 | Katz | A42B 3/32 2/421 |
| 2015/0000012 | A1* | 1/2015 | Ikeda | A42B 3/10 2/411 |
| 2015/0047110 | A1 | 2/2015 | Chilson | |
| 2015/0157083 | A1* | 6/2015 | Lowe | A42B 3/128 2/412 |
| 2017/0013907 | A1 | 1/2017 | Salmini | |
| 2017/0188649 | A1* | 7/2017 | Allen | A63B 71/10 |

FOREIGN PATENT DOCUMENTS

| | | | | |
|---|---|---|---|---|
| JP | 3825106 | A | 9/2006 | |
| KR | 101 003 670 | B1 | 12/2010 | |
| WO | WO-9105489 | A1 * | 5/1991 | A42B 3/12 |

OTHER PUBLICATIONS

Extended European Search Report dated Feb. 12, 2021 for Related Appln. No. EP 18806345.7; 7 Pages.

* cited by examiner

HELMET

CROSS-REFERENCE TO RELATED APPLICATIONS

This application is the U.S. national phase of PCT Application No. PCT/JP2018/008423 filed on Mar. 5, 2018, which claims priority to Japanese Patent Application No. 2017-100732 filed on May, 22, 2017, which are incorporated herein by reference in their entireties.

TECHNICAL FIELD

The present invention relates to a helmet having an outer shell comprising a hard material and a shock absorbing liner disposed inside the outer shell.

BACKGROUND ART

Safety helmets, such as open face helmets and full face helmets for example, are conventionally known as helmets that riders of motorcycles, for example, put on to protect their heads. Such conventional helmets are mainly configured from an outer shell and, disposed inside the shell, a shock absorbing liner, a right and left pair of chin straps, and internal padding for improving the comfort of the wearer. Furthermore, through holes for ventilation are provided at the upper portion of a facial opening provided in the front face of the helmet to ensure a field of view for the wearer.

When a region of part of the outer shell is impacted, the shell functions to disperse the impact to a wider region and absorb the impact energy through deformation. Furthermore, the shock absorbing liner functions to absorb, through a reduction in its thickness (i.e., compression), the impact energy propagated from the outer shell and delay the propagation of the impact energy to the wearer's head to thereby reduce the maximum acceleration resulting from the impact. Here, "maximum acceleration" means the maximum value of acceleration obtained by an "impact absorption test" of the helmet.

To verify the protection of a safety helmet, conventionally an "impact absorption test" is performed. In the "impact absorption test," a model head made of metal is used as a model of the helmet wearer's head. The impact applied to the helmet in the "impact absorption test" is absorbed as described above, and maximum acceleration is measured by an accelerometer disposed inside the model head made of metal as the impact force that finally propagated to the head. The method of the "impact absorption test" and the standard value for maximum acceleration are respectively determined by respective countries.

To enhance the protection performance of a safety helmet, it is necessary to reduce the maximum acceleration produced by an impact. For this purpose, conventionally, measures that increase the thickness of the outer shell and/or the shock absorbing liner have been adopted.

However, because a helmet has a substantially spherical shape, the rigidity of the top portion is inevitably greater than that of the other portions and makes it difficult to absorb an impact. Thus, a structure called an insert liner was invented.

Japanese Patent No. 3,825,106 discloses a structure where a cavity portion is provided in the top portion of the inside of a shock absorbing liner and a separate member is inserted into the cavity portion. The inserted member (called an insert liner) has a smaller density, that is, is softer than the shock absorbing liner, so it can reduce the rigidity of the top portion.

In this way, the impact absorbability of the top portion can be maintained.

SUMMARY OF INVENTION

Technical Problem

Traffic accidents of late include cases where the rider suffers a diffuse axonal injury to the head. Diffuse axonal injury is an injury where axons in the brain become sheared and trauma develops as a result of the brain being violently shaken. The mechanism by which a diffuse axonal injury occurs in the head of a rider is described as follows.

For example, when the right side of the helmet receives an external force caused by an impact, the helmet moves leftward. The cervical spine and trunk of the wearer similarly move even a little leftward because they are not anchored. For that reason, the direction in which the force of impact acts is largely a direction perpendicular to the outer surface of the helmet. The impact acceleration (called "translational acceleration") that occurs because of the external force acting in the perpendicular direction is measured by the "impact absorption test." Conventional insert liner structures have mainly been measures for the translational acceleration of an impact.

However, when an impact is delivered above the helmet in the vicinity of the top portion, the point of impact is higher than the center of gravity of the helmet, so the helmet tries to rotate leftward about the center of gravity. In this way, a force that causes the helmet to rotate, that is, rotational acceleration is produced by the impact. The rotation of the helmet is stopped as a result of the lower end of the helmet hitting the neck of the wearer or because of friction between the helmet and a road surface.

However, the rotational acceleration produced by the impact propagates to the wearer's head. Here, if the wearer has firmly tightened the chin straps, the wearer's head also stops rotating at the same time as the helmet. Moreover, when the rotational acceleration propagates to the inside of the wearer's head, inside the cranium, rotational force acts on the brain floating in the cerebrospinal fluid, and axons interconnecting the brain and the interior of the cranium become sheared.

In consideration of the above circumstances, it is an object of the present invention to obtain a helmet that can effectively reduce the rotational acceleration of an impact and at the same time also effectively reduce translational acceleration.

Solution to Problem

A helmet of a first aspect is a helmet comprising an outer shell configured by a hard material, and a shock absorbing liner disposed inside the outer shell, wherein the shock absorbing liner comprises a main body liner, a recessed portion provided at an inner surface of the main body liner, an insert liner fitted into the recessed portion, and a central support member disposed between a bottom surface of the recessed portion and a bottom surface of the insert liner.

According to the helmet of the first aspect, an impact to the outer shell is absorbed by the shock absorbing liner disposed inside the outer shell becoming deformed. Furthermore, the insert liner is fitted into the recessed portion of the main body liner. The central support member becomes compressively deformed by the impact, and the insert liner tilts. That is, the insert liner moves with respect to the main body liner. At this time, the wearer's head in close contact with the insert liner also moves together with the insert liner, so rotational acceleration does not propagate to the inside of the head. Moreover, in the recessed portion of the main body liner, there is a space in addition to the insert liner and the central support member. That is, volume of the insert liner is reduced rather than density being reduced as in the insert liner of the conventional example, so the same effects as those of the conventional insert liner are obtained. In this way, not only rotational acceleration of the wearer's head but also translational acceleration can be effectively reduced.

A helmet of a second aspect is the helmet of the first aspect, wherein the shock absorbing liner has a plurality of other support members disposed around the central support member.

According to the helmet of the second aspect, by providing the plurality of other support members, even when the wearer's head compresses the insert liner when the wearer tightens the chin straps, the support members support the insert liner together with the central support member, so the helmet can be worn in a stable state without the insert liner tilting and the helmet wobbling.

A helmet of a third aspect is the helmet of the first aspect or the second aspect, wherein the central support member is molded integrally with the insert liner.

According to the helmet of the third aspect, the central support member is molded integrally with the insert liner, so the number of constituent parts of the helmet can be inhibited from increasing.

A helmet of a fourth aspect is the helmet of the second aspect or the third aspect, wherein the cross-sectional area of respective distal end of the other support members is smaller than the cross-sectional area of a distal end of the central support member, and the central support member and the other support members are molded integrally with the insert liner.

According to the helmet of the fourth aspect, the central support member and the other support members are molded integrally with the insert liner, so the number of constituent parts of the helmet can be inhibited from increasing. Furthermore, when the force of impact travels from the bottom surface of the recessed portion to the central support member and the other support members, the other support members with the smaller contact area become deformed or break first, so the central support member can be prevented from being completely destroyed by the impact. In this way, tilting of the insert liner by the central support member can be reliably carried out.

A helmet of a fifth aspect is the helmet of any one of the first aspect to the fourth aspect, wherein a ventilation passage that communicates with an air inlet at a front side of the helmet and a ventilation passage that communicates with an air outlet at a back side of the helmet are provided at the recessed portion, and a ventilation passage that communicates the recessed portion with the inner surface of the main body liner is provided at the insert liner, the inner surface being configured to contact a head region of a wearer.

According to the helmet of the fifth aspect, outside air taken in through the air inlet at the front face of the helmet is guided to the recessed portion of the main body liner and reaches the air outlet at the back side from the recessed portion. Because of this flow of air, heat emanating from the wearer's head is guided from the inner surface of the main body liner through the ventilation passage of the insert liner to the recessed portion. Furthermore, the outside air in the recessed portion goes to the inner surface of the main body liner. In this way, ventilation in the helmet can be excellently carried out.

A helmet of a sixth aspect is the helmet of the fifth aspect, wherein the air inlet is provided in an edge-rolled member in an open portion of a front face of the helmet.

According to the helmet of the sixth aspect, the air inlet is provided at an edge-rolled member disposed at an open portion of a front face of the helmet, which may save extra design and parts for providing the air inlet that runs through the shell.

Advantageous Effects of Invention

The helmet pertaining to the invention has the excellent effect that it can effectively reduce the rotational acceleration of an impact and at the same time also effectively reduce translational acceleration.

DESCRIPTION OF EMBODIMENT

Figure 8A:
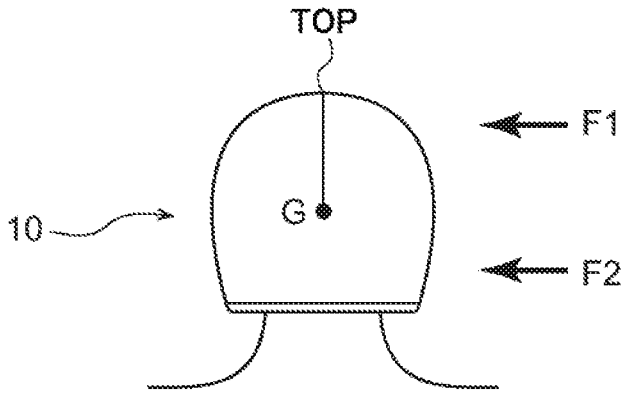
FIG. 8A is a drawing describing the generation of rotational acceleration and is a view in which a rider wearing the helmet before it is impacted is seen from behind.
Figure 8B:
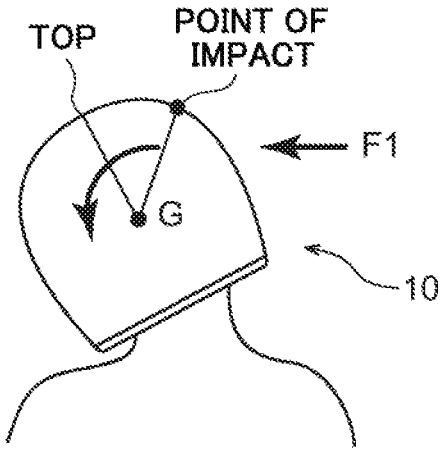
FIG. 8B is a drawing describing the generation of rotational acceleration and is a view in which the rider wearing the helmet when it is impacted is seen from behind.
Figure 8C:
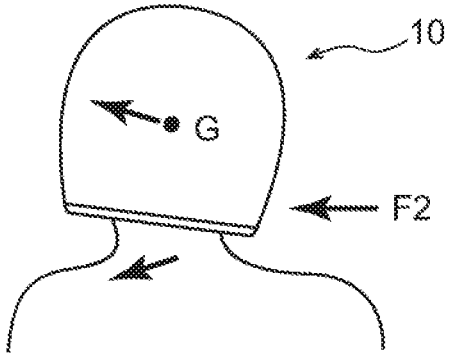
FIG. 8C is a drawing describing the generation of rotational acceleration and is a view in which the rider wearing the helmet when it is impacted is seen from behind.

When a helmet 10 receives an impact F2 at a position lower than its center of gravity (G) as shown in FIG. 8A to FIG. 8C, the neck of the wearer and the trunk supporting the neck move as shown in FIG. 8C. Because of this, a force that pushes the helmet 10 sideways acts. That is, translational acceleration occurs. However, when the helmet 10 receives an impact F1 at a position higher than its center of gravity (G), a force that tries to rotate the helmet 10 acts as shown in FIG. 8B. If the line interconnecting the point of impact and the center of gravity (G) forms a 90-degree to 45-degree angle with the line interconnecting the center of gravity (G) and the top of the helmet 10, both rotational acceleration and translational acceleration occur, but the translational acceleration is greater. Consequently, the force of impact can be mitigated by conventional measures for translational acceleration.

As the angle becomes smaller than 45 degrees, rotational acceleration gradually increases and reaches a maximum at 0 degrees. Thus, in the present invention, it is deemed preferable to provide in a main body liner 16 a recessed portion 30 described later (see FIG. 3) in a position of 0 degrees to 45 degrees with respect to the line connecting the top to the center of gravity (G). Furthermore, it is deemed more preferable to provide the recessed portion 30 in a position of 0 degrees to 20 degrees.

First, the configuration of the helmet 10 pertaining to an embodiment of the present invention will be described using FIG. 1A to FIG. 6. It will be noted that arrow FR indicates a forward direction in a front and rear direction as seen from the perspective of a wearer currently using the helmet, arrow RH and arrow LH indicate a rightward direction and a leftward direction, respectively, and arrow UP indicates an upward direction in an up and down direction. Furthermore, when the directions of front/rear, right/left, and upper/lower are simply used in the following description, these will be understood to mean front/rear, right/left, and upper/lower as seen from the perspective of the wearer currently wearing the helmet.

Figure 1A:
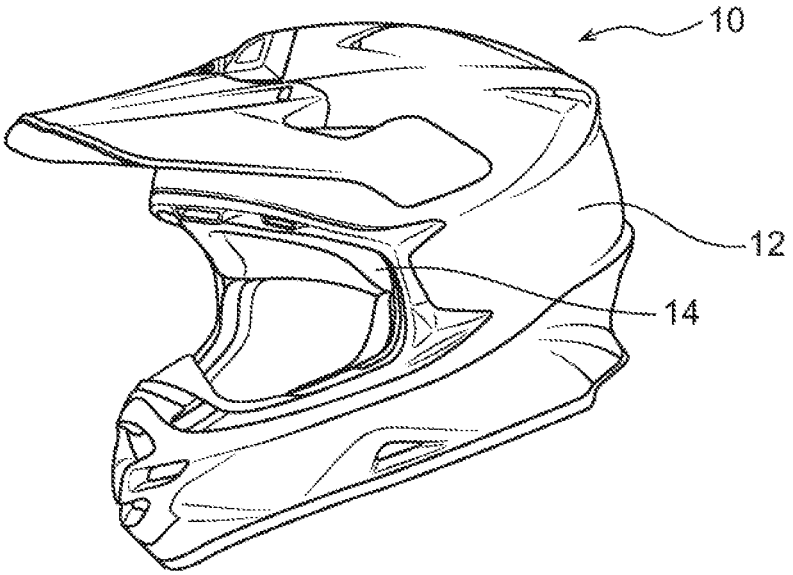
FIG. 1A is a side view showing a helmet of an embodiment.
Figure 1B:
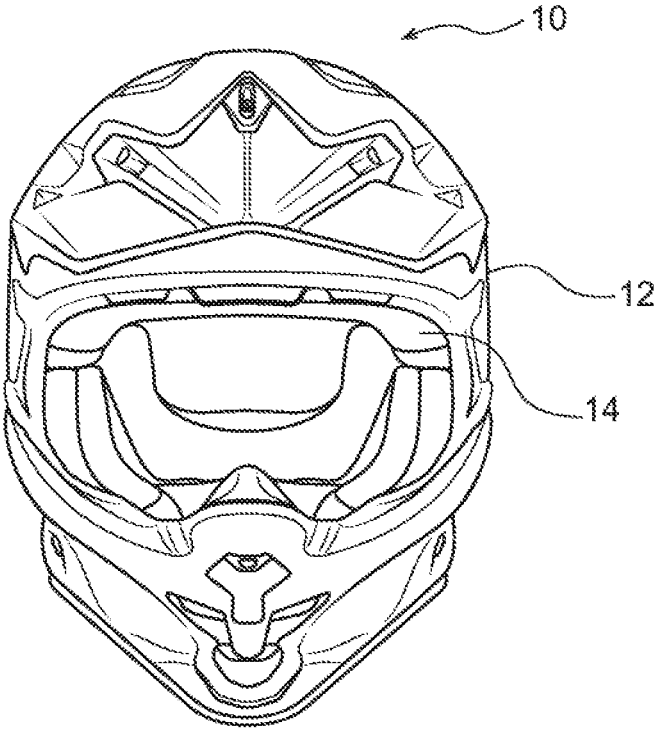
FIG. 1B is a front view showing the helmet of the embodiment.

As shown in FIG. 1A and FIG. 1B, the helmet 10 of the present embodiment has an outer shell 12 formed with a hard material such as fiber-reinforced plastic and a shock absorbing liner 14 disposed inside the shell 12 and joined to an inner surface of the shell 12.

Figure 2:
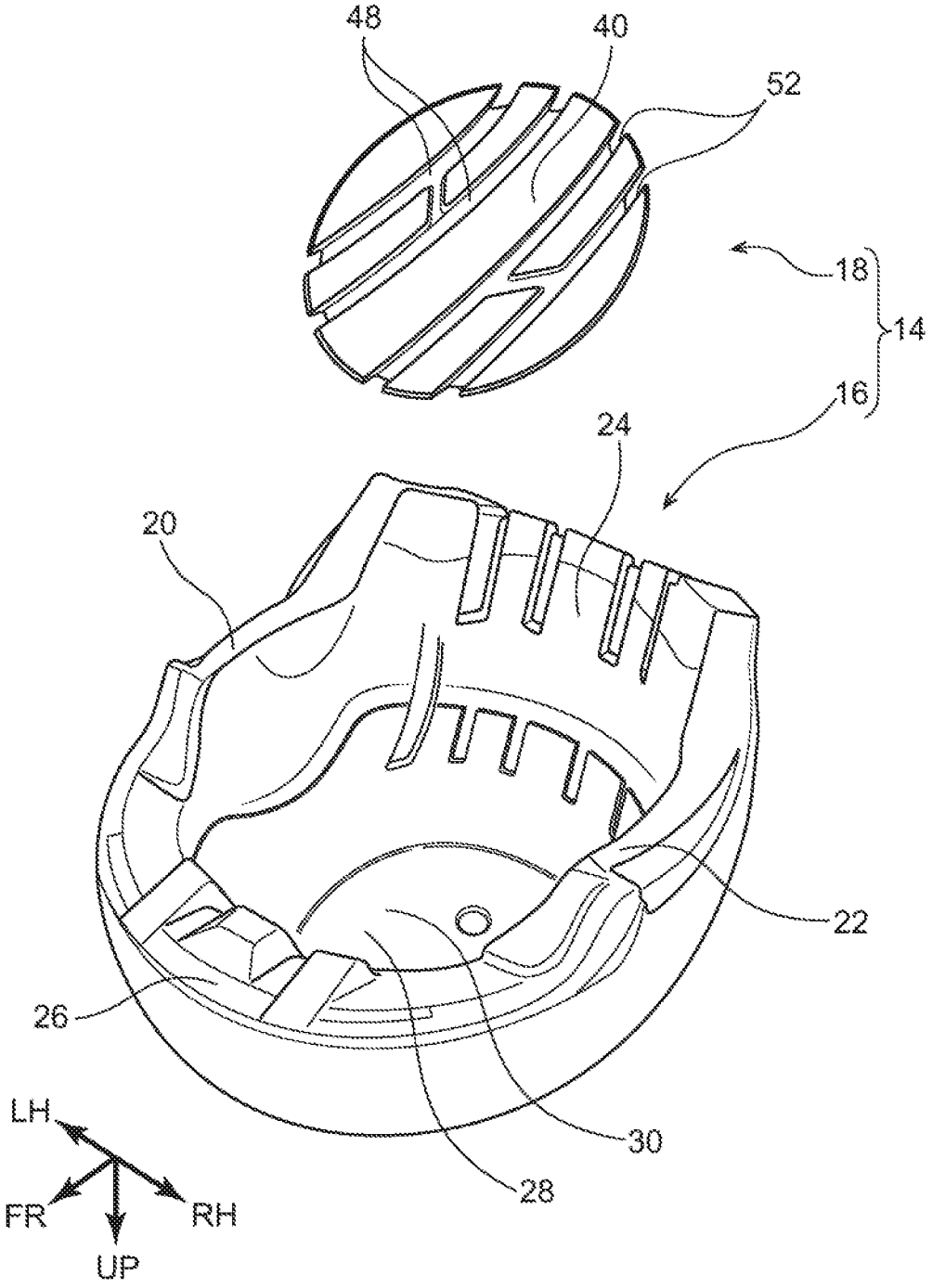
FIG. 2 is an exploded perspective view showing a shock absorbing liner.

As shown in FIG. 2, the shock absorbing liner 14 has a main body liner 16 and an insert liner 18 attached to the main body liner 16. Moreover, the main body liner 16 has a recessed portion 30 for fitting the insert liner 18 therein.

Figure 3:
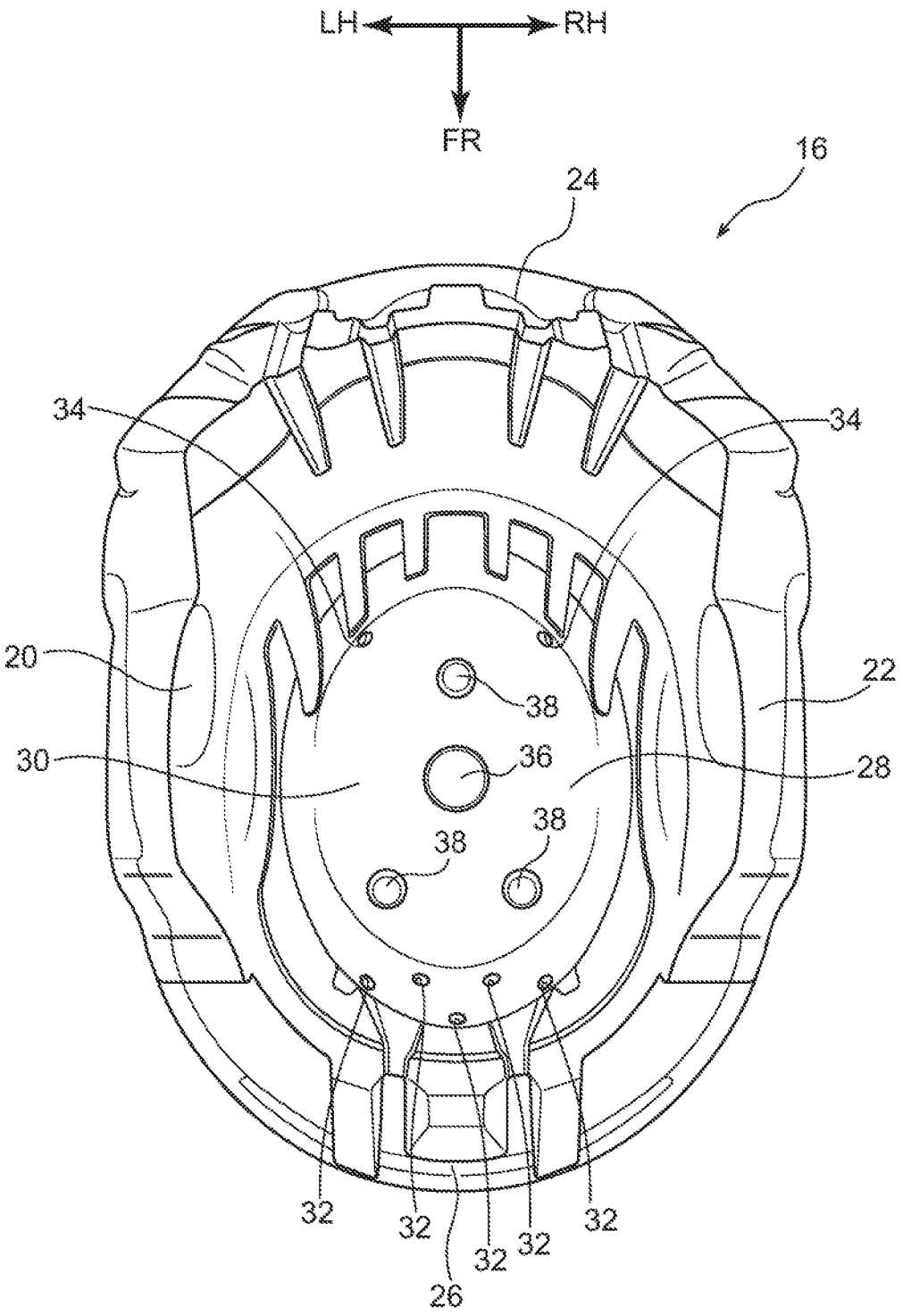
FIG. 3 is a plan view showing a main body liner.

As shown in FIG. 3, the main body liner 16 is formed using synthetic resin foam, and the main body liner 16 is formed in the shape of a dome (a recessed shape) in which one side thereof is open. Specifically, the main body liner 16 has a left liner portion 20 and a right liner portion 22 that are disposed along the side portions of the user's head, a rear liner portion 24 that is disposed along the rear portion of the user's head, and a front liner portion 26 that is disposed along the front portion of the user's head. Furthermore, the main body liner 16 has an upper liner portion 28 that is disposed opposing the top portion of the user's head. When seen from the underside of the main body liner 16, the upper liner portion 28 has an elliptical shape whose longitudinal direction coincides with the front and rear direction and whose transverse direction coincides with the right and left direction, and the recessed portion 30 into which the insert liner 18 described later (see FIG. 2) is fitted is formed in the upper liner portion 28. Ventilation holes 32 that communicate with an air inlet at a front side of the helmet 10 and ventilation holes 34 that communicate with an air outlet at the back side of the helmet 10 are formed in the recessed portion 30. Furthermore, a central recessed portion 36, whose edge portion is circular as seen from below and with which a central raised portion 42 (see FIG. 4B) of the insert liner 18 described later mates, is formed in the right and left direction and front and rear direction center portion of the recessed portion 30. Moreover, three peripheral recessed portions 38, with which three peripheral raised portions 44 (see FIG. 4B) of the insert liner 18 described later mate, are formed around the central recessed portion 36. In the present embodiment, two peripheral recessed portions 38 disposed an interval apart from each other in the right and left direction are formed at the front side of the central recessed portion 36, and one peripheral recessed portion 38 is formed in the right and left direction center portion at the rear side of the central recessed portion 36.

The position of the recessed portion 30 in the main body liner 16 is preferably within an elliptical shape formed by the intersection of the surface of the outer shell of the helmet 10 with a cone drawn when the line interconnecting the position of the center of gravity of the helmet 10 and the top of the helmet 10 (see FIG. 8A to FIG. 8C) is tilted 45 degrees around the helmet 10, and more preferably within a 20-degree cone. Furthermore, the original thickness of the main body liner 16 when it is supposed that the recessed portion 30 is not provided is preferably 15 to 55 mm and more preferably 35 to 45 mm. At this time, the depth of the recessed portion 30 is preferably 35 mm or less and more preferably 25 mm or less.

Figure 4A:
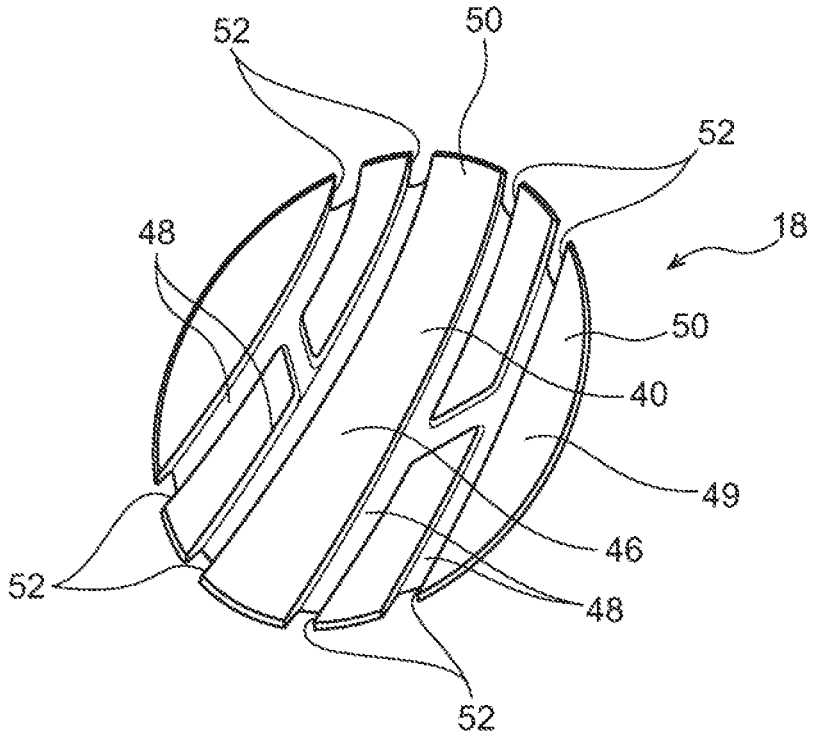
FIG. 4A is a perspective view of an insert liner as seen from the side of a user's head.
Figure 4B:
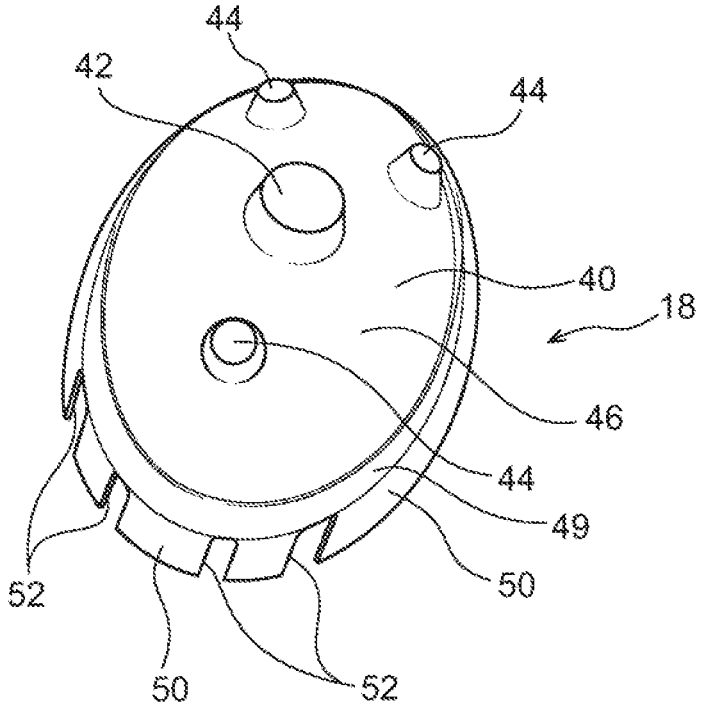
FIG. 4B is a perspective view of the insert liner as seen from the opposite side of the user's head.

As shown in FIG. 4A and FIG. 4B, the insert liner 18 is formed using synthetic resin foam like the main body liner 16. Specifically, the insert liner 18 has an insert liner main body portion 40, which is formed in the shape of a shallow bowl (a recessed shape) in which one side thereof is open, and the central raised portion 42 serving as a central support member and the three peripheral raised portions 44 serving as other support members, which project upward from the surface on the upper side of the insert liner main body portion 40. The surface on the underside of the insert liner main body portion 40 curves in a shape following the top portion of the user's head, and plural grooves 48 for ventilation are formed therein. Furthermore, a thin-walled portion 50 is disposed at the end portion of an outer periphery 49 of the insert liner main body portion 40. The thin-walled portion 50 has a thinner wall thickness than the insert liner main body portion 40, and plural cutout portions 52 serving as communicating portions that are continuous with the plural grooves 48 and whose edge portions are substantially U-shaped as seen from below are formed in the thin-wall portion 50. In this way, the surface on the underside of the insert liner 18 (the surface that contacts the wearer's head) has a shape that is longitudinally and bilaterally symmetrical. To industrially manufacture the insert line 18, it is preferably circular or elliptical in shape. Furthermore, the central raised portion 42 is formed substantially in the shape of a solid cylinder and projects upward from the front and rear direction center portion and the right and left direction center portion of the surface on the upper side of the insert liner main body portion 40. Furthermore, the three peripheral raised portions 44 are each formed substantially in the shape of a circular truncated cone with a smaller outer diameter than the central raised portion 42. In the present embodiment, two peripheral raised portions 44 disposed an interval apart from each other in the right and left direction are formed at the front side of the central raised portion 42, and one peripheral raised portion 44 is formed in the right and left direction center portion at the rear side of the central raised portion 42.

Figure 4C:
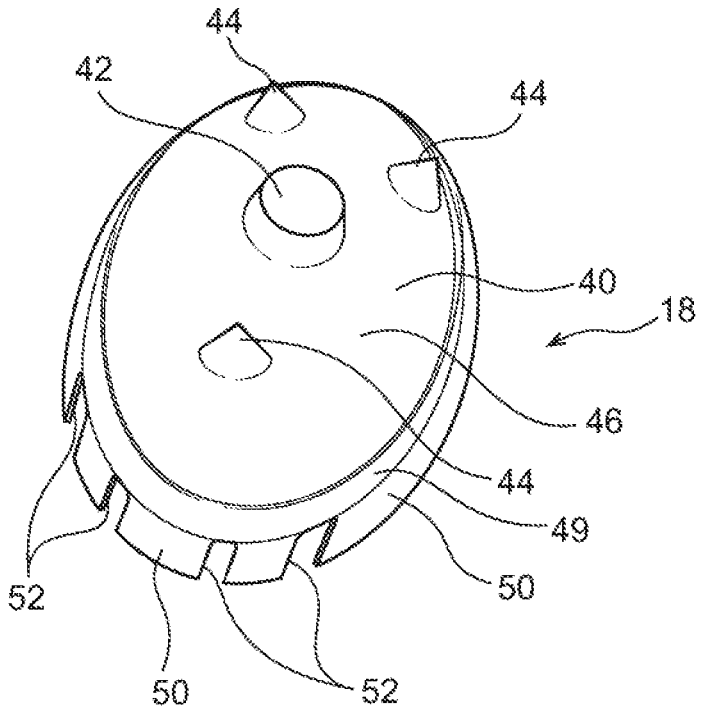
FIG. 4C is a perspective view of the insert liner having another configuration as seen from the opposite side of the user's head.
Figure 4D:
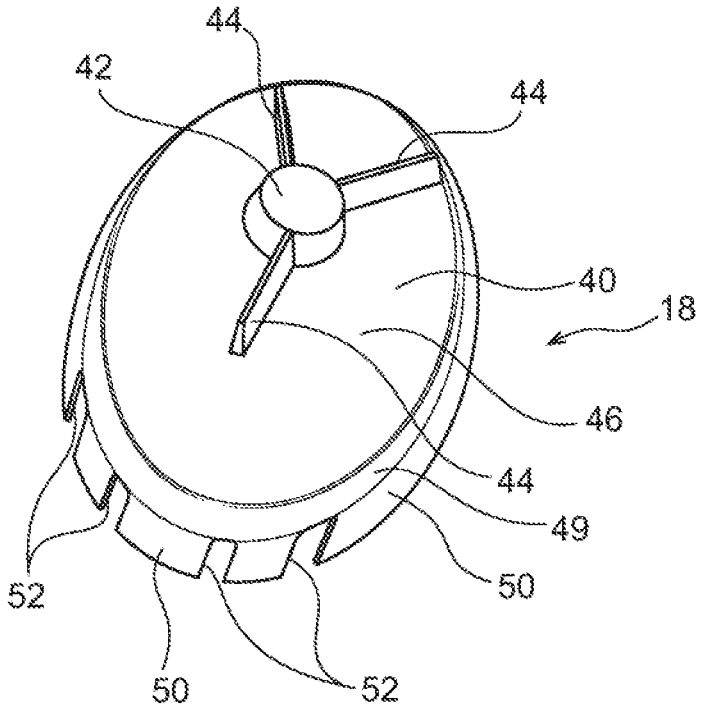
FIG. 4D is a perspective view of the insert liner having another configuration as seen from the opposite side of the user's head.

The insert liner 18 preferably has a thickness of 5 mm or more from its surface on the underside (the surface facing the wearer's head) to the bottom surface of the recessed portion 30 of the main body liner 16, and more preferably has a thickness of 10 to 15 mm. Moreover, the central raised portion 42 and the peripheral raised portions 44 prevent the insert liner 18 from being pushed by the wearer's head and wobbling when the helmet is put on. However, when a region in the vicinity of the top portion of the helmet receives an impact, first, the peripheral raised portions 44 become deformed, bent, or cracked by the impact force, but because the central raised portion 42 supports the insert liner 18 in its center position, a phenomenon occurs where part of the insert liner 18 sinks into the recessed portion 30 and the part on the opposite side comes up. That is, the insert liner 18 tilts with respect to the main body liner 16. Next, the sunk-in peripheral raised portion 44 comes up because of repulsive force from the bottom surface of the recessed portion 30 (the surface of the upper liner portion 28), and then the central raised portion and the other peripheral raised portions 44 to which the impact has propagated after that become deformed, bent, or crack and sink into the recessed portions. In this way, the insert liner 18 swings (oscillates). It will be noted that the peripheral raised portions 44 may also have conical distal ends as shown in FIG. 4C, or may also be shaped like walls (mountain ridgelines) such as the Great Wall of China, for example, as shown in FIG. 4D, so that their area of contact with the bottom surface of the recessed portion 30 becomes smaller. Furthermore, the cross section of each of the central raised portion 42 and the peripheral raised portions 44 at the surface on the upper side of the insert liner is preferably circular or elliptical in shape with a diameter of 50 mm or less and more preferably with a diameter or 30 mm or less.

Figure 5:
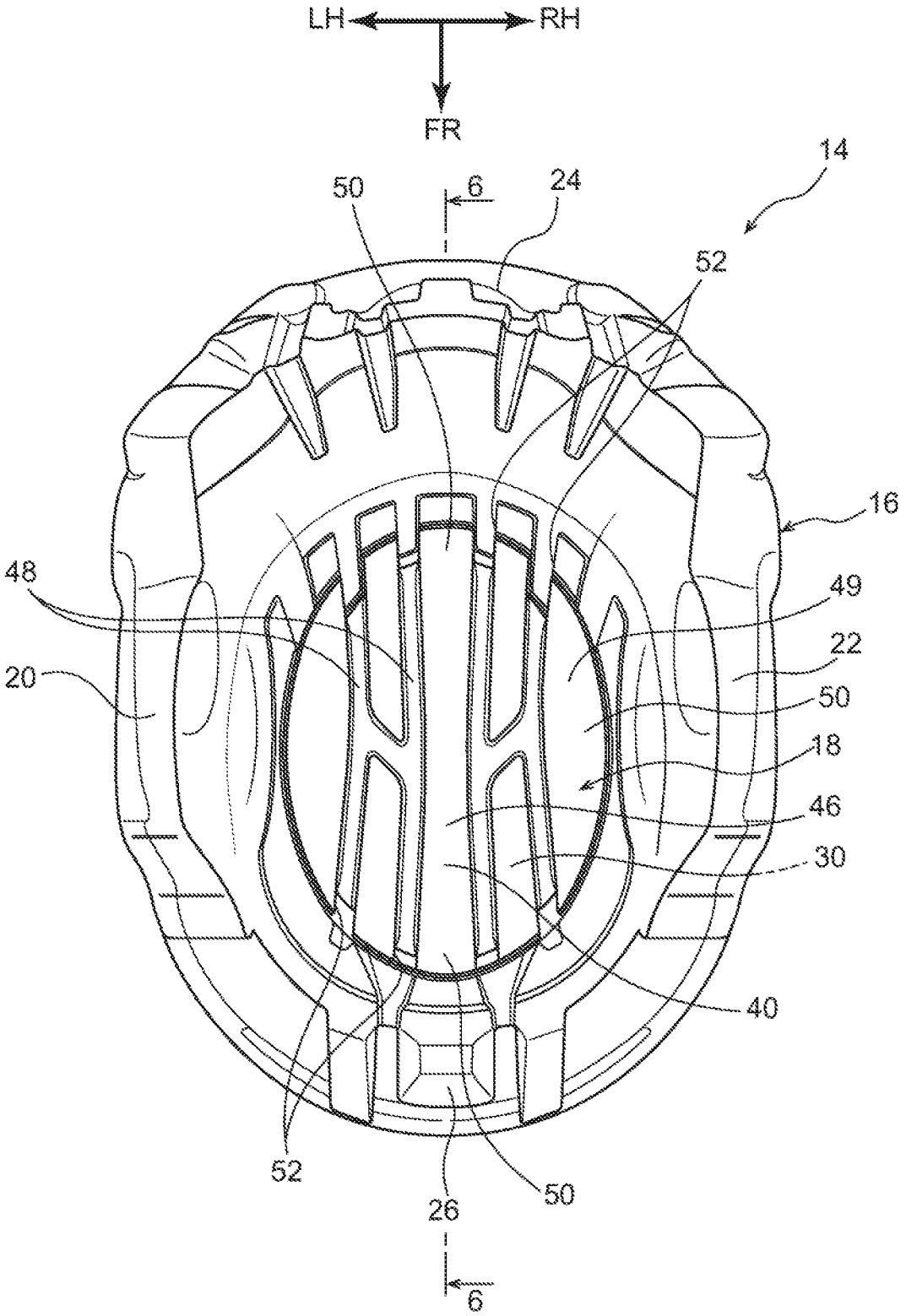
FIG. 5 is a plan view showing the main body liner to which the insert liner has been attached.
Figure 6A:
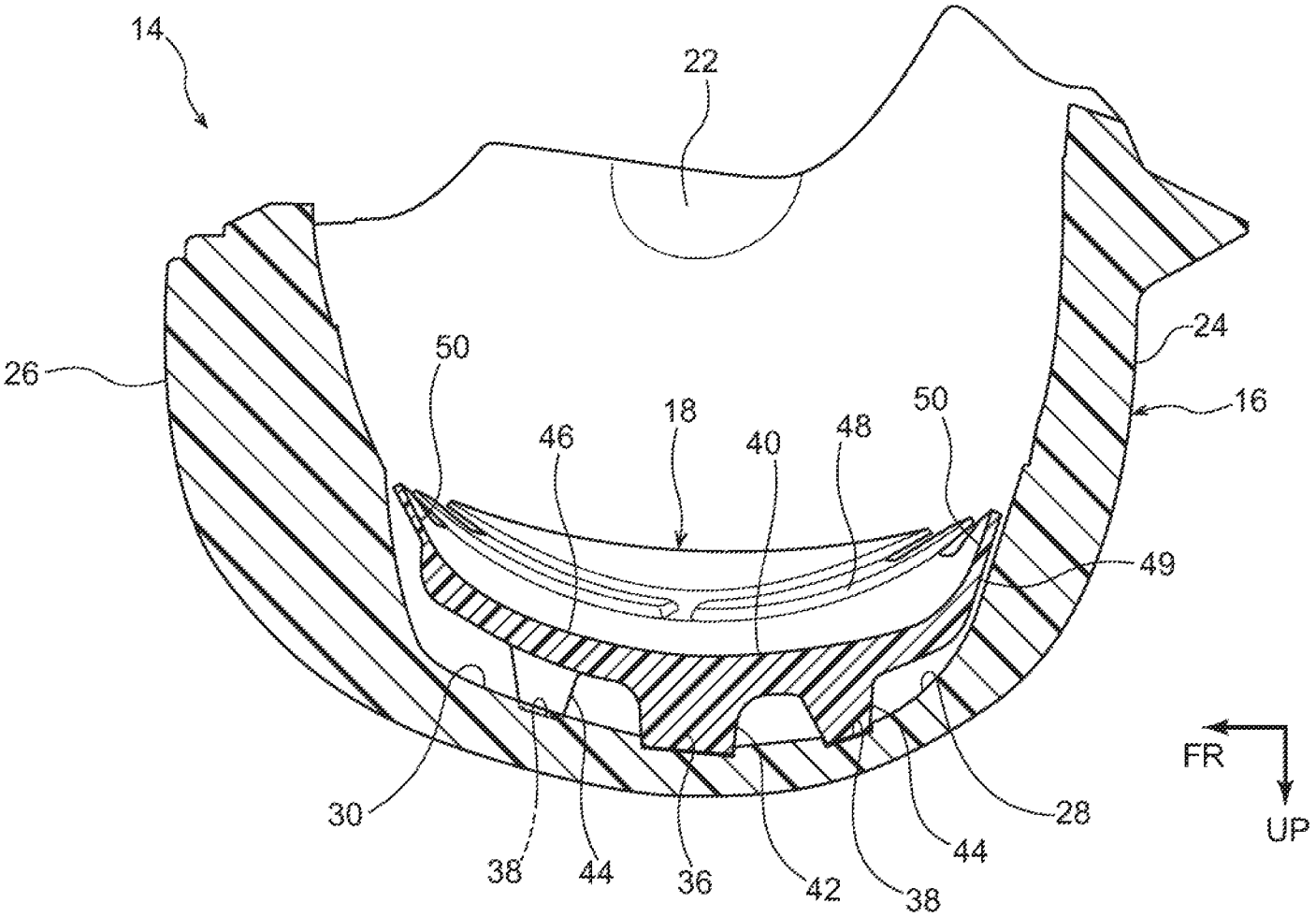
FIG. 6A is a sectional view showing the insert liner and the main body liner cut along line 6-6 shown in FIG. 5.

As shown in FIG. 5 and FIG. 6A, the insert liner 18 described above is attached (secured) to the main body liner 16 in a state in which the insert liner 18 has been fitted into the recessed portion 30 of the main body liner 16. Specifically, the insert liner 18 is secured to the main body liner 16 in a state in which the central raised portion 42 and the three peripheral raised portions 44 are engaged with the central recessed portion 36 and the three peripheral recessed portions 38 of the main body liner 16. It will be noted that in the present embodiment an adhesive is interposed between the central raised portion 42 of the insert liner 18 and the central recessed portion 36 of the main body liner 16 so that the insert liner 18 does not conic away from the main body liner 16 even when the helmet is taken off.

Furthermore, in a state in which the insert liner 18 is secured to the main body liner 16, a gap is formed between the surface on the upper side of the insert liner main body portion 40 of the insert liner 18 and the main body liner 16. In order for the insert liner 18 to swing (oscillate and move with respect to the main body liner), a gap formed between the outer periphery 49 of the insert liner 18 and the inner wall of the recessed portion 30 is preferably 10 mm or less and more preferably 3 mm to 7 mm. Moreover, it is possible for the central raised portion 42 and the three peripheral raised portions 44 of the insert liner 18 to be members separate from the insert liner 18 and the main body liner 16, and to industrially manufacture them, the central raised portion 42 and the three peripheral raised portions 44 may be integrally molded on the bottom surface of the insert liner 18 or integrally molded on the bottom surface of the recessed portion 30 of the main body liner 16.

Furthermore, the thin-walled portion 50 covers and hides the space between the outer periphery 49 of the insert liner 18 and the inner wall of the recessed portion 30; however, when the insert liner 18 swings, the thin-walled portion 50 becomes pushed against the inner wall of the recessed portion 30 and easily becomes deformed or broken, so it does not obstruct the swinging.

(Action and Effects of Embodiment) Next, the action and effects of the embodiment will be described.

Figure 6B:
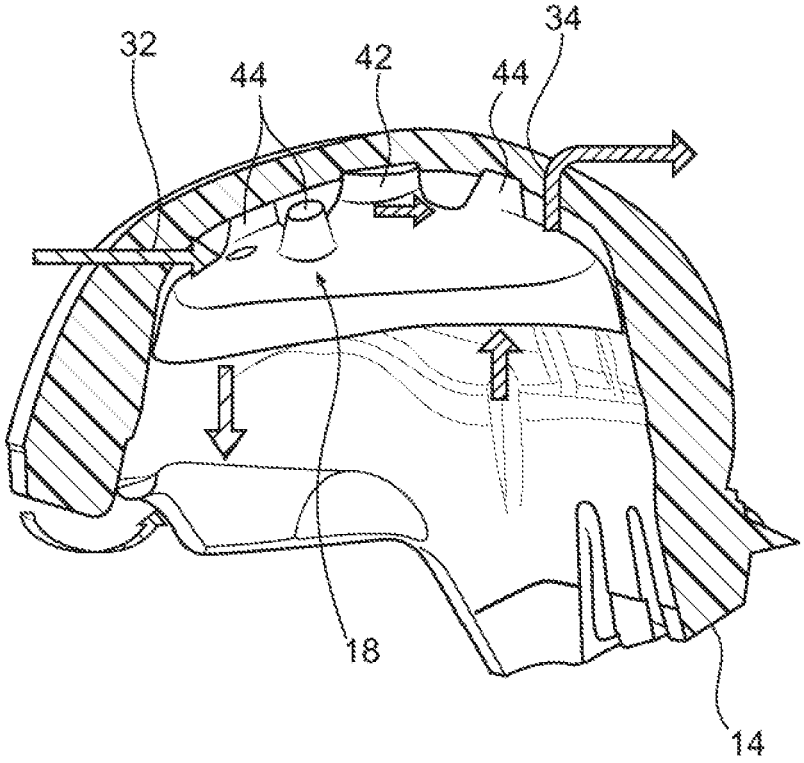
FIG. 6B is a sectional view of the main body liner of the embodiment showing ventilation holes inside the main body liner.

As shown in FIG. 1A, FIG. 1B, and FIG. 2, according to the helmet 10 described above, an impact to the outer shell 12 is absorbed as a result of the shock absorbing liner 14 disposed inside the outer shell 12 becoming deformed. Furthermore, as shown in FIG. 5, FIG. 6A, and FIG. 6B, the insert liner 18 is fitted into the recessed portion 30 of the main body liner 16. The insert liner may be disposed entirely within a top half of the outer shell as measured from a top-most point of the outer shell to a lower-most point of the outer shell. Additionally, the central raised portion 42 and the three peripheral raised portions 44 become deformed, thereby reducing translational acceleration, and the insert liner is moved (swings) with respect to the main body liner 16, whereby rotational acceleration of the head of the user wearing the helmet 10 can be effectively reduced.

Specifically, a gap is provided between the insert liner 18 and the recessed portion 30, so as soon as the impact travels to the insert liner 18, instantaneously the phenomenon of rising and sinking occurs (i.e., the insert liner 18 swings). Because the insert liner 18 swings in this way, the wearer's head in close contact with the insert liner 18 also swings and rocks together with the insert liner 18. That is, even if the rotation of the helmet 10 is stopped after rotational force has occurred in the helmet 10 because of an impact, the wearer's head inside the helmet 10 continues to move, so the rotational acceleration caused by the impact does not propagate to the inside of the head or can be reduced.

In order to maximize the rocking effect resulting from the rising and sinking (swinging) of the insert liner 18, it is necessary for the insert liner 18 to tilt centering on the center point of the insert liner 18. Thus, it is preferred to provide the central raised portion 42 in the center point of the bottom surface of the insert liner 18 and dispose the peripheral raised portions 44 therearound. Furthermore, by giving the peripheral raised portions 44 a shape that becomes deformed more easily than the central raised portion 42, deformation occurs starting at the peripheral raised portions 44 because of an impact, so the tilting of the insert liner 18 centered on the central raised portion 42 can be promoted.

Here, test results of an impact test of the helmet 10 will be described.

(Test Results of Impact Test)

The helmet 10 was put on a model head and dropped on top of a steel anvil from a height of 2.5 m, and the rotational force produced by the impact at that time was measured by an angular velocimeter. It will be noted that the places of impact were the three points of the vicinity of the top portion of the helmet 10, the front portion in a case where the helmet 10 was tilted 45 degrees forward, and the left side portion in a case where the helmet was tilted 45 degrees leftward.

TABLE 1

Impact Test Results (Unit: rad/s2)

| | When Conventional Insert Liner was Used | When Swinging Insert Liner was Used |
|---|---|---|
| Top Portion | 10,133 | 6,665 |
| Front Portion | 12,280 | 10,692 |
| Left Side Portion | 10,571 | 8,731 |

As will be apparent from table 1, when the swinging insert liner 18 was used as in the helmet 10 of the embodiment, rotational acceleration was clearly reduced compared to the conventional insert liner. It will be noted that the conventional insert liner is a type where the insert liner does not swing with respect to the main body liner.

Furthermore, in the helmet 10 of the embodiment, as shown in FIG. 4B, FIG. 6A, and FIG. 6B, the insert liner 18 can be maintained in a stable state by providing the three peripheral raised portions 44 in addition to the central raised portion 42.

Furthermore, if only the central raised portion 42 is provided, the insert liner 18 is unstable just with the wearer putting on the helmet 10 (the insert liner 18 easily tilt's with respect to the main body liner 16), so comfort is poor. Furthermore, if the translational acceleration of the impact is too large, it is expected that the central raised portion 42 will not be able to support the wearer's head and be easily crushed, resulting in the insert liner 18 caving in substantially parallel to the recessed portion 30. That is, in this case, the rising and sinking phenomenon of the insert liner 18 does not occur. Thus, in the present embodiment, by providing, in addition to the central raised portion 42, the three peripheral raised portions 44 in which the cross-sectional area of their distal ends is smaller than that of the central raised portion 42, the force with which the insert liner 18 is supported can be reinforced. Additionally, translational acceleration can be buffered as a result of any of the three peripheral raised portions 44 being deformed or bent, and rotational acceleration can also be buffered as a result of the insert liner 18 producing the rising and sinking phenomenon.

Moreover, in this embodiment, as shown in FIG. 3, FIG. 5, and FIG. 6B, the ventilation holes 32, 34 serving as ventilation passages that communicate with the air inlet at the front side of the helmet 10 and the air outlet at the back side of the helmet 10 are provided, and the cutout portions 52 that communicate the recessed portion 30 with the wearer's head region are provided at the insert liner 18. An air flow arises wherein outside air taken in through the air inlet in the front face of the helmet 10 is introduced through the ventilation holes 32 formed in the recessed portion 30 of the main body liner 16 to the inside of the recessed portion 30 and is then discharged via the ventilation holes 34 through the air outlet. For that reason, heat emanating from the wearer's head is guided through the cutout portions 52 (communicating portions) to the recessed portion of the main body liner. Moreover, some of the outside air introduced to the recessed portion 30 reaches the wearer's head through the cutout portions 52 (communicating portions). In this way, the ventilation performance inside the helmet 10 can be enhanced. That is, heat inside the helmet 10 is discharged so that comfort can be provided to the wearer. Furthermore, by providing, in the top portion including the recessed portion 30, the ventilation holes 32, 34 that communicate with the front side and back side of the helmet 10, the main body liner 16 more easily absorbs translational acceleration caused by an impact. It will be noted that although in the present embodiment the cutout portions 52 are provided as the communicating portions for communicating the wearer's head region with the recessed portion 30, the communicating portions are not limited to this, and plural communicating holes that run through the insert liner 18 may also be provided.

Furthermore, in the insert liner 18 of the present embodiment, the thin-walled portion 50 whose thickness is thinner compared to the thickness of a center portion 46 is disposed at the end portion of the outer periphery 49 of the insert liner main body portion 40. In addition to this, the plural cutout portions 52 are formed in the thin-walled portion 50. The rigidity of the thin-walled portion 50 is reduced because of the cutout portions 52. Because of this, when the helmet 10 is impacted, the thin-walled portion 50 is easily deformed or broken, so the thin-walled portion 50 does not obstruct the moving (swinging) of the insert liner. Additionally, in the present embodiment, the insert liner 18 is reinforced by disposing the plural peripheral raised portions 44 around the central raised portion 42 so that the central raised portion 42 does not become crushed and the insert liner 18 swings without collapsing into the recessed portion 30.

Figure 7A:
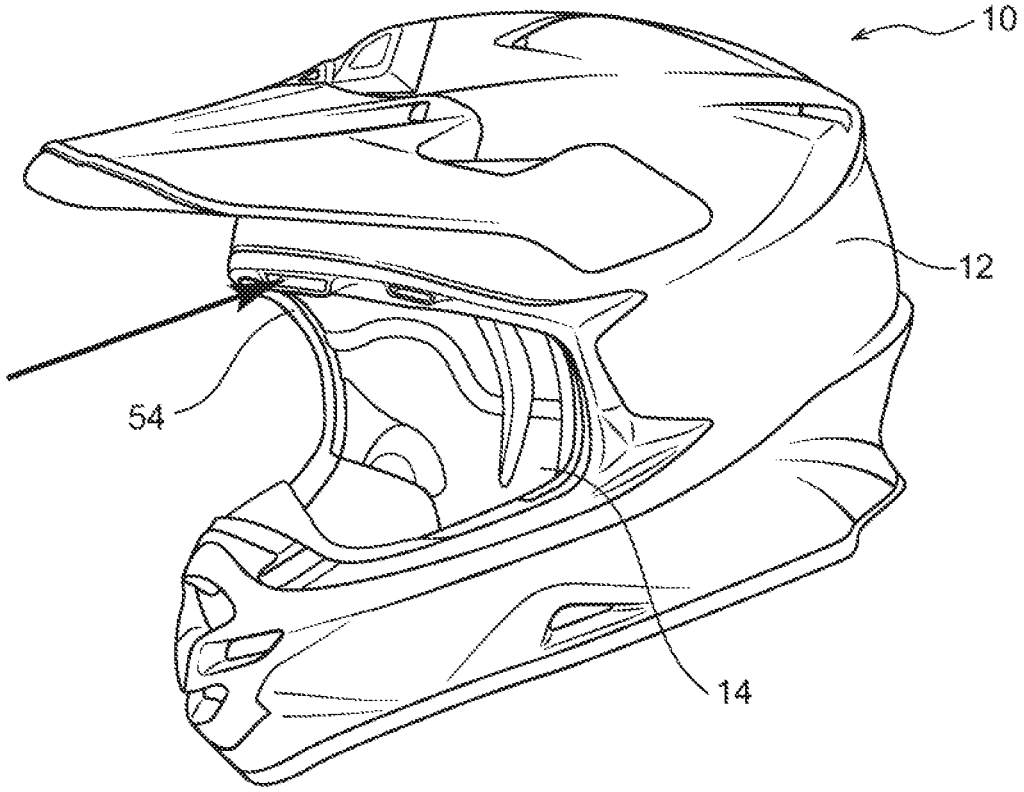
FIG. 7A is a perspective view, seen obliquely from a front side, showing an air inlet in the helmet of the embodiment.
Figure 7B:
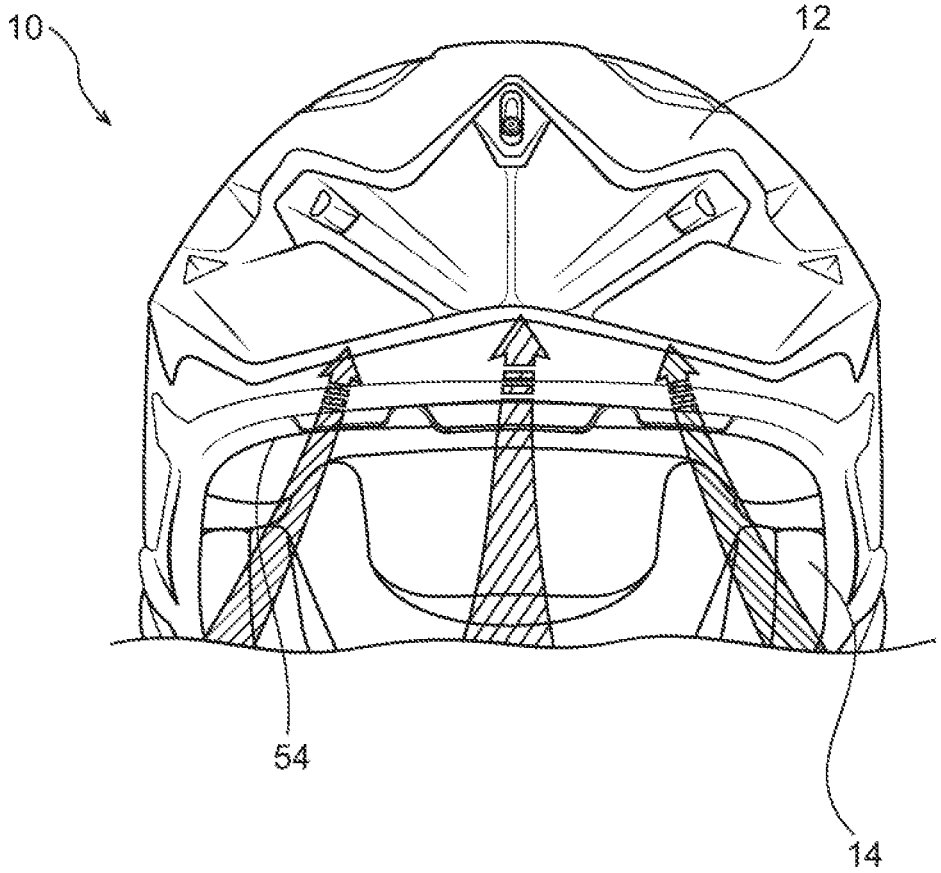
FIG. 7B is a front view showing the air inlet in the helmet of the embodiment.

Furthermore, in the present embodiment, as shown in FIG. 7A and FIG. 7B, the air inlet is provided at an edge-rolled member 54 in the open portion of the front face of the helmet, and outside air that has been taken in is divided in two, with one flow traveling over the outer surface of the main body liner 16 and reaching the recessed portion 30 through the ventilation holes 32 and the other flow traveling over the inner surface of the main body liner 16 and being guided to the ventilation grooves 48 provided at the underside of the insert liner 18. In this way, the number of parts for the air inlet can be reduced and the number of manhours for assembly can be reduced.

An embodiment of the invention has been described above, but the invention is not limited to what is described above and can of course be modified and implemented in a variety of ways, in addition to what is described above, in a range that does not depart from the scope thereof.

The invention claimed is:

1. A helmet, comprising an outer shell including a hard material, and a shock absorbing liner disposed inside the outer shell, wherein the shock absorbing liner comprises a main body liner, a recessed portion provided at an inner surface of the main body liner, an insert liner fitted into the recessed portion, and a central support member disposed between a bottom surface of the recessed portion and a bottom surface of the insert liner, wherein the insert liner is disposed entirely within a top half of the outer shell measured from a top-most point of the outer shell to a lower-most point of the outer shell, a first ventilation passage that communicates with an air inlet at a front side of the helmet and a second ventilation passage that communicates with an air outlet at a back side of the helmet are provided at the recessed portion, and a third ventilation passage that communicates the recessed portion with the inner surface of the main body liner is provided at the insert liner, the inner surface being configured to contact a head region of a wearer, wherein a plurality of grooves are formed at an underside of the insert liner, the plurality of grooves extend substantially in a front-rear direction and substantially in a left-right direction of the helmet, a plurality of cutout portions are formed at outer peripheral end of the insert liner and the plurality of cutout portions are continuous with the plurality of grooves, and the recessed portion of the main body liner is configured to be in fluid communication with the head region of the wearer via the plurality of cutout portions.

2. The helmet according to claim 1, wherein the shock absorbing liner comprises a plurality of other support members disposed around the central support member.

3. The helmet according to claim 2, wherein a cross-sectional area of respective distal ends of the plurality of other support members is smaller than a cross-sectional area of a distal end of the central support member, and the central support member and the plurality of other support members are molded integrally with the insert liner.

4. The helmet according to claim 2, wherein the central support member is molded integrally with the insert liner.

5. The helmet according to claim 1, wherein the central support member is molded integrally with the insert liner.

6. The helmet according to claim 5, wherein the shock absorbing liner comprises a plurality of other support members disposed around the central support member, the plurality of other support members having respective distal ends, and wherein a cross-sectional area of the respective distal ends of the plurality of other support members is smaller than a cross-sectional area of a distal end of the central support member, and the plurality of other support members are molded integrally with the insert liner.

7. The helmet according to claim 1, wherein the air inlet is provided at an edge-rolled member disposed at an open portion of a front face of the helmet.

8. A helmet, comprising:
an outer shell; and
an inner liner, including:
a main body liner having
a recessed portion,
a first ventilation passage located inside the recessed portion and defined by a plurality of ventilation holes, and
an insert liner fitted into the recessed portion and connected to the main body liner via a plurality of support members, wherein the insert liner is disposed entirely within a top half of the helmet measured from a top-most point of the helmet to a lower-most point of the helmet, and a gap between an outer peripheral end of the insert liner and the main body liner defines a second ventilation passage configured to avow air into and out of the recessed portion, the insert liner including:
a plurality of grooves formed at an underside of the insert liner extending substantially in a front-rear direction and substantially in a left-right direction of the helmet, and
a plurality of cutout portions being continuous with the plurality of grooves formed at outer peripheral end of the insert liner.

9. The helmet of claim 8, wherein the plurality of support members are molded integrally with the insert liner.

10. The helmet of claim 8, wherein the plurality of support members include a frustoconical-shaped member.

11. The helmet of claim 8, wherein the plurality of support members include a conical-shaped member.

12. The helmet of claim 8, wherein the plurality of support members include a wall-shaped member.

13. The helmet of claim 8, wherein the plurality of support members include:
a central support member located at a longitudinal center line of the helmet; and
at least two other support members boated on either side of the longitudinal center line of the helmet, such that the insert liner is configured to rotate about the central support member when the at least two other support members are deformed.

14. A helmet liner made of shock absorbing material, comprising:
a main body liner having
a recessed portion,
a first ventilation passage located inside the recessed portion and defined by a plurality of ventilation holes, and
an insert liner fitted into the recessed portion and connected to the main body liner via a plurality of support members, wherein a gap between an outer peripheral end of the insert liner and the main body liner defines a second ventilation passage configured to allow air into and out of the recessed portion,
wherein the plurality of support members includes:
a central support member located at a longitudinal center line of the helmet liner, and
at least two other support members located on either side of the longitudinal center line of the helmet liner, the at least two other support members having a smaller dimension than the central support member requiring less force to deform such that the insert liner is configured to rotate about the central support member when the at least two other support members are deformed,
wherein the insert liner is disposed entirely within a top half of a main body liner measured from a top-most point of the main body liner to a lower-most point of the main body liner.

15. The helmet liner of claim 14, wherein the insert liner includes:
a plurality of grooves formed at an underside of the insert liner extending substantially in a front-rear direction and substantially in a left-right direction of the helmet liner, and
a plurality of cutout portions being continuous with the plurality of grooves formed at outer peripheral end of the insert liner.

16. The helmet liner of claim 14, wherein the central support member is frustoconical-shaped.

17. The helmet liner of claim 16, wherein the at least two other support members include a conical-shaped member.

18. The helmet liner of claim 16, wherein the at least two other support members include a wall-shaped member.

* * * * *